US006218912B1

(12) United States Patent
Mayer

(10) Patent No.: US 6,218,912 B1
(45) Date of Patent: Apr. 17, 2001

(54) MICROWAVE SWITCH WITH GROOVES FOR ISOLATION OF THE PASSAGES

(75) Inventor: Bernd Mayer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/291,384

(22) Filed: Apr. 14, 1999

(30) Foreign Application Priority Data

May 16, 1998 (DE) ..... 198 22 072

(51) Int. Cl.[7] ..... H01P 1/10
(52) U.S. Cl. ..... 333/106; 333/108
(58) Field of Search ..... 333/105, 106, 333/108, 259

(56) References Cited

U.S. PATENT DOCUMENTS 3,155,923 * 11/1964 Persson ..... 333/106 X
4,761,622 8/1988 Cracknell et al. ..... 333/106
4,806,887 2/1989 Au-Yeung ..... 333/106

FOREIGN PATENT DOCUMENTS

2250140 * 5/1992 (GB) ..... 333/106
58-141003 8/1983 (JP) .
53-70647 * 5/1992 (JP) ..... 333/106

* cited by examiner

*Primary Examiner*—Justin P. Bettendorf
(74) *Attorney, Agent, or Firm*—Michael J. Striker

(57) ABSTRACT

The microwave switch includes a housing (1) and a rotor (2) having a rotor axis (A). The rotor (2) includes respective plate-shaped parts (10,20) having corresponding ring-shaped outer surfaces (OS, OS') and walls (15 to 18) extending between the plate-shaped parts. The rotor (2) is provided with through-going passages (7,8,9) extending transversely to the rotor axis (A) between the plate-shaped parts (10,20) and the walls (15 to 18). Grooves (6) for improving isolation of the passages (7,8,9) are provided only in the ring-shaped outer surfaces (OS, OS') and extend longitudinally substantially parallel to the rotor axis (A). The grooves (6) open into the passages and the passages are bounded by the plate-shaped parts (10,20) in both directions of the rotor axis.

6 Claims, 2 Drawing Sheets

MICROWAVE SWITCH WITH GROOVES FOR ISOLATION OF THE PASSAGES

BACKGROUND OF THE INVENTION

The present invention relates to microwave switches.

Microwave switches are known, for example from Japanese patent application 58-141003A which was published on Aug. 22, 1983. The microwave switch disclosed in this reference has a circular cylindrical rotor having a ring-shaped outer surface provided with longitudinal and transverse slots or grooves. Due to their deep pass action, they deviate as as little high frequency energy as possible through a gap between the rotor and the housing.

A microwave switch is also disclosed in U.S. Pat. No. 4,806,887. As particularly shown in FIG. 8 and defined in claim 18, it has grooves or so-called chokes which extend parallel to the axis of the rotor on the ring-shaped outer surface, and in particular each between two high frequency passages of the rotor. Finally, U.S. Pat. No. 4,761,622 discloses a microswitch with circumferential grooves provided on the ring-shaped outer surface of the rotor as shown in FIGS. 8, 13, 14. They serve for compensating the asymmetry of the rotor.

So-called R switches for microwaves are used in the satellite technology as redundant switches. As shown in the cross-section of FIG. 3, they have a housing I and a rotor 2. Four hollow conductor terminals (gates) 11–14 of the housing 1 are connected with one another in a different manner depending on the position of the rotor. In the rotor position shown in FIG. 3, the gate 11 is connected for example with the gate 14, and the gate 12 is connected with the gate 13. When the rotor 2 is turned by 45° in clockwise direction, the gate 11 is connected with the gate 13. For this purpose, the rotor 2 has two passages, namely a straight passage 7 and two bent passages 8, 9.

Conventionally, a very high mutual isolation of the gates which are not connected with one another is required. When for example as shown in FIG. 3, the gate 11 is connected with the gate 14 and the gate 11 is supplied with the microwave signal, then a smallest possible signal portion must exit through the gate 12 and the gate 13. In the case when the gate 11 is connected with the gate 13, the gate 12 and the gate 14 must be isolated. Moreover, the gate 12 must be insulated from the gate 14. The isolation is determined by the ratio $P_{ISO}/P_{EIN}$ of the power $P_{ISO}$ occurring at the insulated gate to a power $P_{EIN}$ supplied into a gate. For redundance circuit networks in satellites, generally a value of −60dB is required. These very high requirements for the isolation can be provided only as special features:

- by the longitudinal grooves 4 which are formed in the side wall of the straight passage in the rotor and which extended longitudinally parallel to the axis of the rotor;
- by the longitudinal grooves 5 which are formed in the housing 1;
- by a very narrow gap 3 between the rotor and the housing.

With an operational frequency of 10 GHz (Ku-band), a gap of 50 $\mu$m is required for this. With higher operational frequencies, correspondingly narrower gaps are needed. With a doubling of the operational frequency to 20 GHz, the gap width must be halved to 25 $\mu$m to provide the same isolation as the isolation provided with 10 GHz. Narrower gaps are not possible for reliability reasons. Moreover, then the required accuracy can not be achieved with conventional production methods such as milling or turning.

Since the longitudinal grooves in the rotor shown in FIG. 3 must have very narrow tolerances due to the very thin wall thickness and the housing grooves are provided by an expensive eroding method, the microwave switch of the prior art has a high production cost. Since the eroding generally is performed by special firms, the production time increases significantly.

SUMMARY OF THE INVENTION

Accordingly, it is an object of present invention to provide a microwave switch which avoids the disadvantages of the prior art.

In keeping with these objects and with others which will become apparent hereinafter, one feature of the present invention resides, briefly stated, in a microswitch with a housing and a rotor having passages with longitudinal directions extending transversely to an axis of the rotor as well as grooves in the ring-shaped outer surface of the rotor for improving the insulation between the passages, wherein in accordance with the inventive feature the grooves open into the passages.

When the microwave switch is designed in accordance with the present invention, it is possible without forming the longitudinal grooves in the side walls of the straight passages of the rotor (4 in FIG. 3) and without the longitudinal grooves formed in the housing (5 in FIG. 3), to provide the same good or even improved electrical properties, in particular in an R switch. Moreover, in accordance with the present invention, it is possible to provide a substantially wider gap than used the rotor and the housing, or with the same gap width to provide a high operational frequency. By avoiding the previously existing longitudinal grooves in the housing, a substantial reduction of the production cost is obtained.

Since in the microwave switch in accordance with the present invention only short grooves must be milled in the lower and upper limiting plates of the passages of the rotor, these grooves allow greater tolerances.

The exact shape and position of the grooves in accordance with the present invention must be optimized for a corresponding application (waveguide band, operational frequency), for example by corresponding research.

The novel features which are considered as characteristic of the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
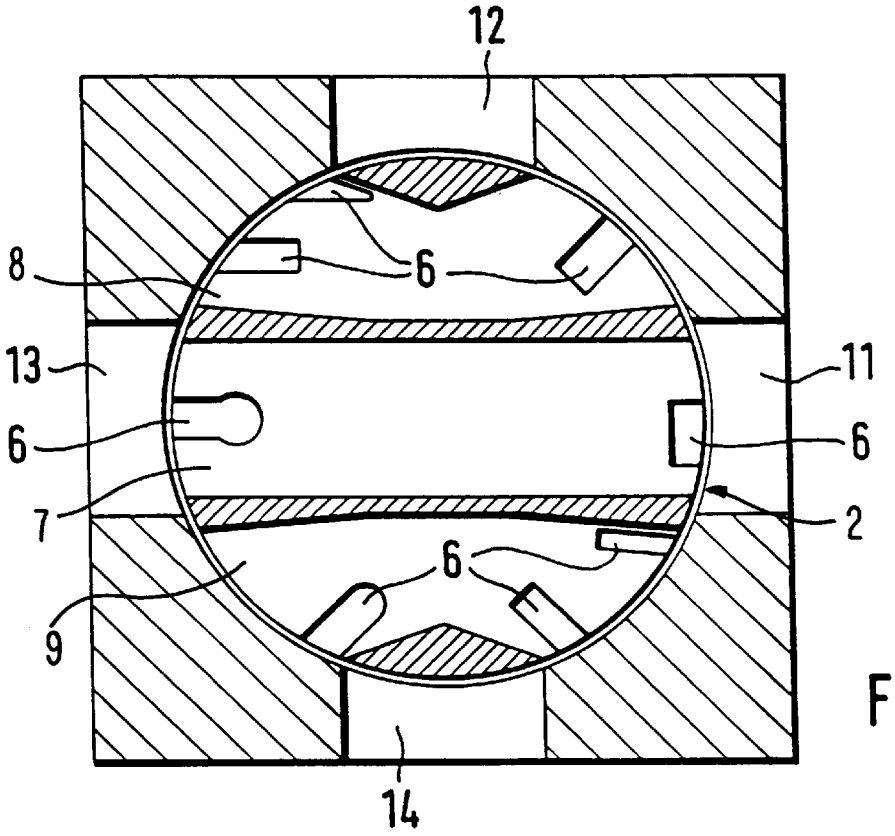
FIG. 1 is a view showing a basic cross-section through a microwave switch in accordance with the present invention with various alternatives for grooves.
Figure 3:
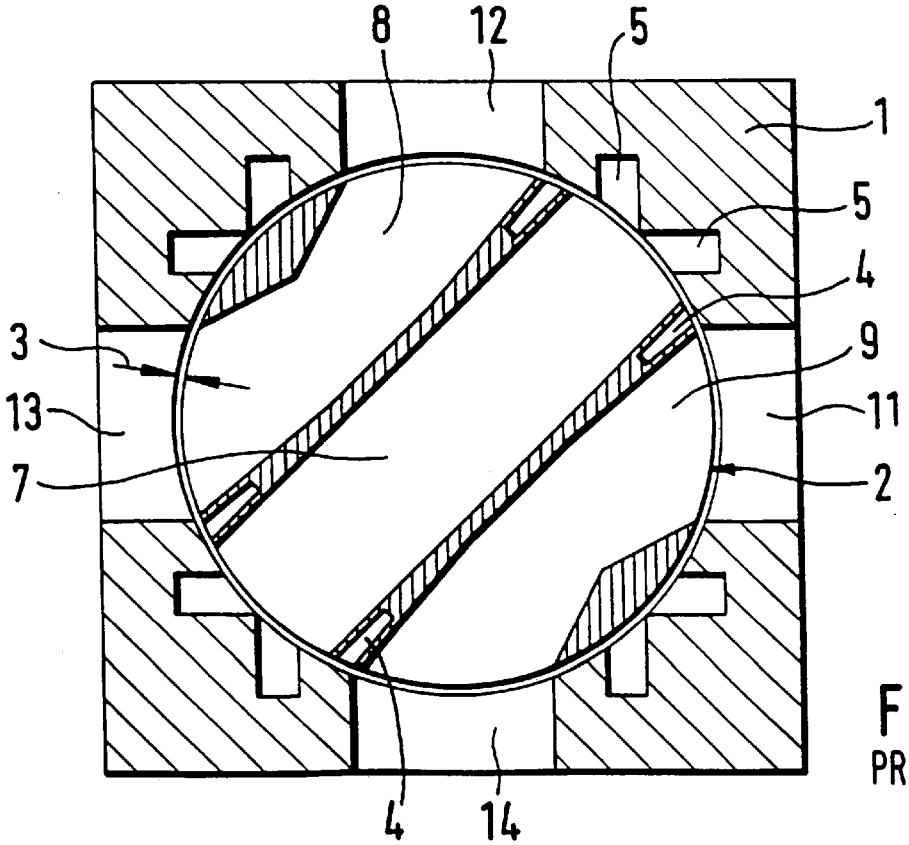
FIG. 3 PRIOR ART
FIG. 3 is a basic cross-section through a known microwave switch which is formed as an R switch.

FIG. 1 shows a cross-section of a microwave switch in accordance with the present invention which is different from a known microwave switch shown in FIG. 3. The cross-section of FIG. 1 is a view on a plate-shaped part 10 in FIG. 2, which limits passages 7, 8, 9 in a direction of the rotor axis A facing the plane of the drawings. Various grooves 6 are provided in the ring-shaped outer OS surface of OS the plate-shaped part 10. In the illustrated embodiment of the present invention they are not provided simultaneously, but instead only different alternatives are identified. The selection of the alternatives is performed during an optimization process for the corresponding applications.

Figure 2:
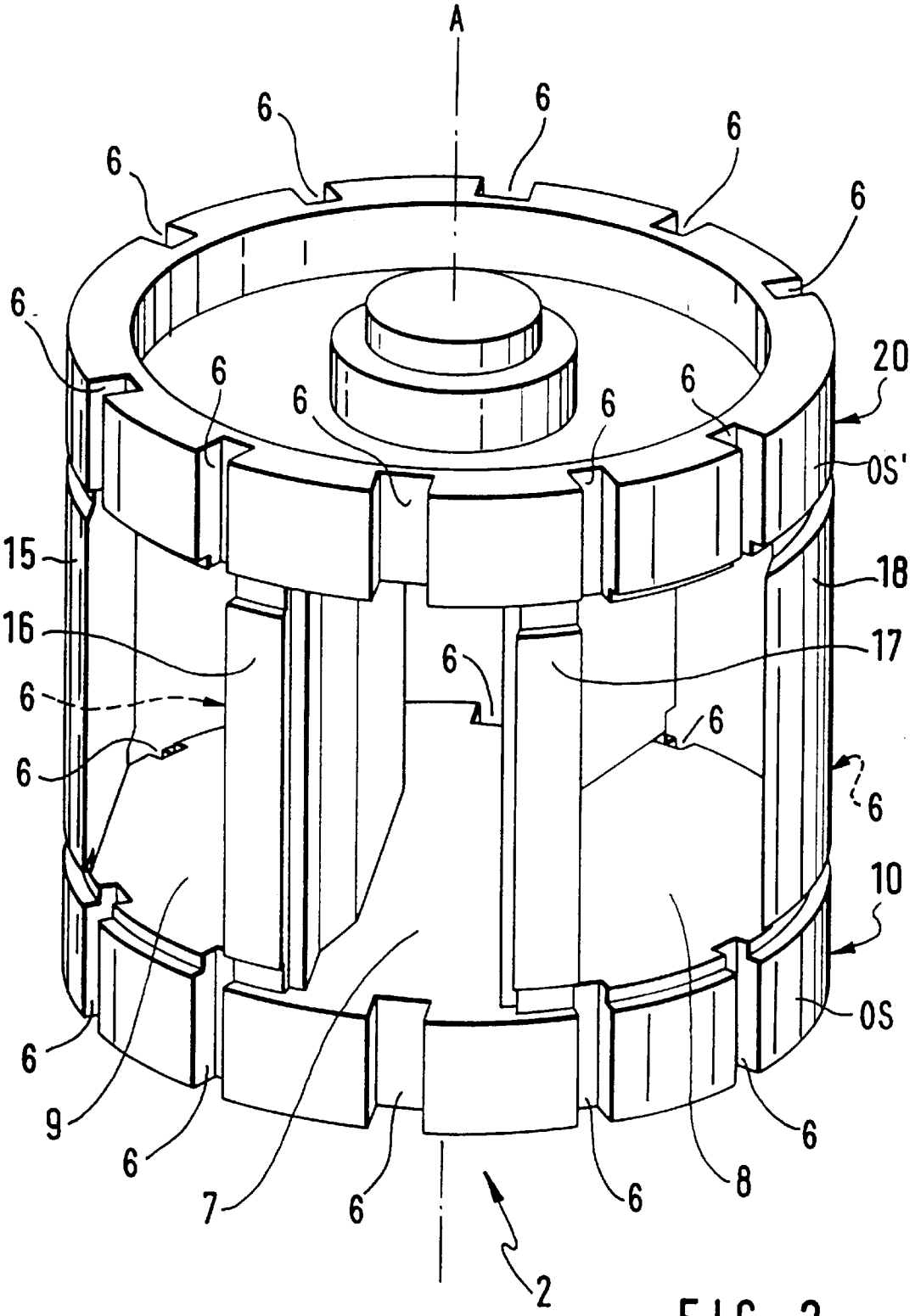
FIG. 2 is a perspective view of a rotor of a microwave switch in accordance with the present invention.

The rotor 2 is illustrated in FIG. 2 for one of such applications. The housing of an inventive microwave switch does not carry any new features, and a corresponding illustration of the housing is dispensed with.

A central, straight passage 7 and two bent or buckled, flanking passages 8 and 9 are provided in the rotor 2. The longitudinal directions or the signal transmitting directions of the passages extend transversely to the axis A of the rotor, which in FIG. 2 extends vertically. In the upward direction of the rotor axis, the passages 7, 8, 9 are limited by a plate-shaped part 20.

Grooves 6 are provided in the ring-shaped outer surfaces OS, OS' of the plate-shaped parts 10 and 20 and thereby also in the ring-shaped outer surface of the rotor 2. Their longitudinal extensions deviate from the corresponding circumferential direction of the outer surface of the rotor since they extend parallel to the rotor axis. These grooves are located correspondingly in the region between the walls 15–18, the walls limiting the passages 7,8,9 in direction perpendicular to the rotor axis. Some of the grooves 6 are located correspondingly centrally between both opposite walls 16, 18 of the passage 7.

Four longitudinal grooves 6 are located at the inlet or outlet of the passages 8 and 9 respectively and open into them. Each of two neighboring grooves are arranged in the same plate-shaped part 10 or 20 closer to one of the walls 16–18 than the other groove. In other words, eight grooves 6 in the outer ring-shaped surfaces OS,OS' open into each of the arcuate passages 8 and 9. Each of these eight grooves is located near one of the walls 17,18; 15,16 that bound the respective passages.

The cross-section of all grooves is preferably rectangular. It corresponds thereby to some of the alternatives 6 in FIG. 1. When the central, straight passage 7 is not provided, a so-called seat-switch is obtained. The present invention is also applicable to this switch.

In a rotor for R switches according to the invention as shown in FIG. 2, with the operational frequency of 20 GHz, an isolation of −60 dB is provided, while the gap width between the rotor and the housing can be increased from 50 to 60 $\mu$m.

It will be understood that each of the elements described above, or two or more together, may also find a useful application in other types of constructions differing from the types described above.

While the invention has been illustrated and described as embodied in microwave switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A microwave switch comprising a housing (1) and a rotor (2) having a rotor axis (A), wherein said rotor comprises respective plate-shaped parts (10,20) having corresponding ring-shaped outer surfaces (OS,OS') and walls (15,16,17,18) extending between said plate-shaped parts (10,20), said rotor (2) being provided with through-going passages (7,8,9) extending transversely to said rotor axis (A) between said plate-shaped parts (10,20) and said walls (15,16,17,18), said plate-shaped parts (10,20) being provided with a plurality of grooves (6) in said ring-shaped outer surfaces (OS,OS') in order to improve isolation of said passages (7,8,9), said grooves extending in a longitudinal direction thereof so as to be substantially parallel to said rotor axis (A) and opening into said passages, said passages (7,8,9) being bounded by said plate-shaped parts (10,20) in both directions of said rotor axis (A).

2. The microwave switch as defined in claim 1, wherein said grooves (6) are arranged in said plate-shaped parts (10,20) circumferentially spaced between respective opposing pairs (15,16;16,17;17,18) of said walls bounding said passages.

3. The microwave switch as defined in claim 1, wherein two of said grooves are located in one of said ring-shaped outer surfaces circumferentially spaced from each other and from opposing ones of said walls bounding one of said passages.

4. The microwave switch as defined in claim 1, wherein said passages include two flanking passages (8,9) of an R switch and a central passage (7) located between said two flanking passages.

5. The microwave switch as defined in claim 1, wherein at least one of said passages is an R switch outer passage.

6. The microwave switch as defined in claim 1, wherein said walls have outer surfaces and none of said grooves (6) are provided in said outer surfaces of said walls.

* * * * *